United States Patent [19]

Whatley et al.

[11] Patent Number: 4,530,645

[45] Date of Patent: Jul. 23, 1985

[54] OIL WELL PUMPING APPARATUS

[75] Inventors: David L. Whatley; Wallace M. Chaviers, both of Wichita Falls, Tex.

[73] Assignee: Hydraunit Venture, Wichita Falls, Tex.

[21] Appl. No.: 77,537

[22] Filed: Sep. 21, 1979

[51] Int. Cl.[3] ..... F04B 47/04

[52] U.S. Cl. ..... 417/399; 91/219; 91/275; 91/393

[58] Field of Search ..... 417/399, 401; 91/219, 91/275, 319, 393, 397, 400, 405, 406, 449; 60/372

[56] References Cited

U.S. PATENT DOCUMENTS

| | | | |
|---|---|---|---|
| 2,504,218 | 4/1950 | Noll et al. | 91/219 X |
| 2,572,748 | 10/1951 | Noll et al. | 60/372 |
| 2,582,564 | 1/1952 | Schneck et al. | 60/376 |
| 2,934,899 | 5/1980 | Koplin et al. | 60/369 |
| 4,198,820 | 4/1980 | Roth et al. | 91/275 X |

FOREIGN PATENT DOCUMENTS

| | | | |
|---|---|---|---|
| 1212214 | 11/1970 | United Kingdom | 91/275 |

*Primary Examiner*—Leonard E. Smith
*Attorney, Agent, or Firm*—Wilkinson, Mawhinney & Theibault

[57] ABSTRACT

The present system and apparatus for pumping an oil well damps out the stretch and over travel in sucker rod over travel particularly when the rod string approaches its point of reversal of direction either up or down. This is accomplished by decelerating the rate of travel of the rod string and at its end of travel pausing for a time period sufficient to allow rod string oscillations to damp out prior to reversal of rod string direction which due to the long length of the rod string, its weight and the weight of the trapped oil avoids breaking the rod string and the time loss occasioned thereby in both loss of well production and costly replacement of equipment and the time loss resulting therefrom.

The present invention also achieves substantial recovery of hi-viscosity oil not recoverable at present by standard recovery procedures. This is accomplished with a sensor positioned to be actuated by the ram of the hydraulic drive. When the sensor is actuated, it energizes a time delay relay which holds the sucker rod string in the upper most raised position allowing the suction to be maintained on the bottom hole pump with the standing valve open. This allows the hi-viscus oil to enter the bottom hole pump barrel. When the time delay relay is released, the sucker rod string starts its downward movement closing the bottom hole standing valve. This traps the hi-viscus oil in the pump barrel which is then displaced by the downward movement of the plunger in the bottom hole pump.

7 Claims, 10 Drawing Figures

Fig. 9

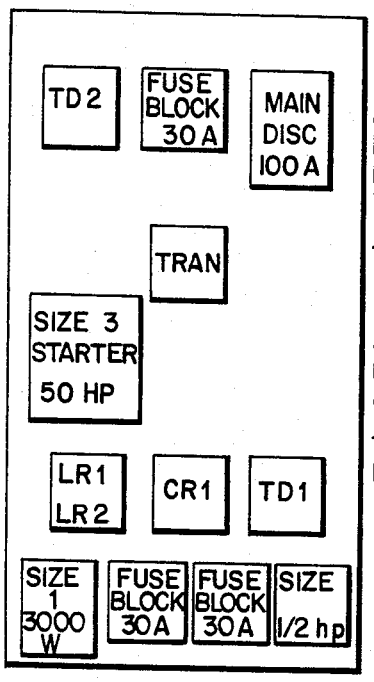

CR-1 - Sq. D relay KP13. Close on start.
LS #1 - Sq. D Class 9007 limit sw. Close on bottom stroke.
LS #3 - Sq. D Class 9007 limit sw. Close on top stroke.
LR #1 - Line relay RLP2A Coil #1 Close on bottom stoke.
LR #2 - Line relay RLP2A Coil #2 Close on top stroke.
TD # 1 - Siemens pneumatic timing relay # 7PQ80044. Close on bottom stroke.
TD # 2 - Siemens pneumatic timing relay # 7PQ80044. Close on top stroke.
HVI-D Close bottom stroke after delay valve opens.
HV2-B Close top stroke after delay valve opens.
HV3-A Close on contact near bottom of stroke for deceleration.
L.O.S.- Oil sw open on low oil.
T1 - Oil therm close on Hi temp.
T2 - Oil therm close on Lo temp.
LS #2 - Sq. D Class 9007 limit sw close when contacted on down stroke.
( No latching relay req'd for LS #2 normal open).

Fig. 8

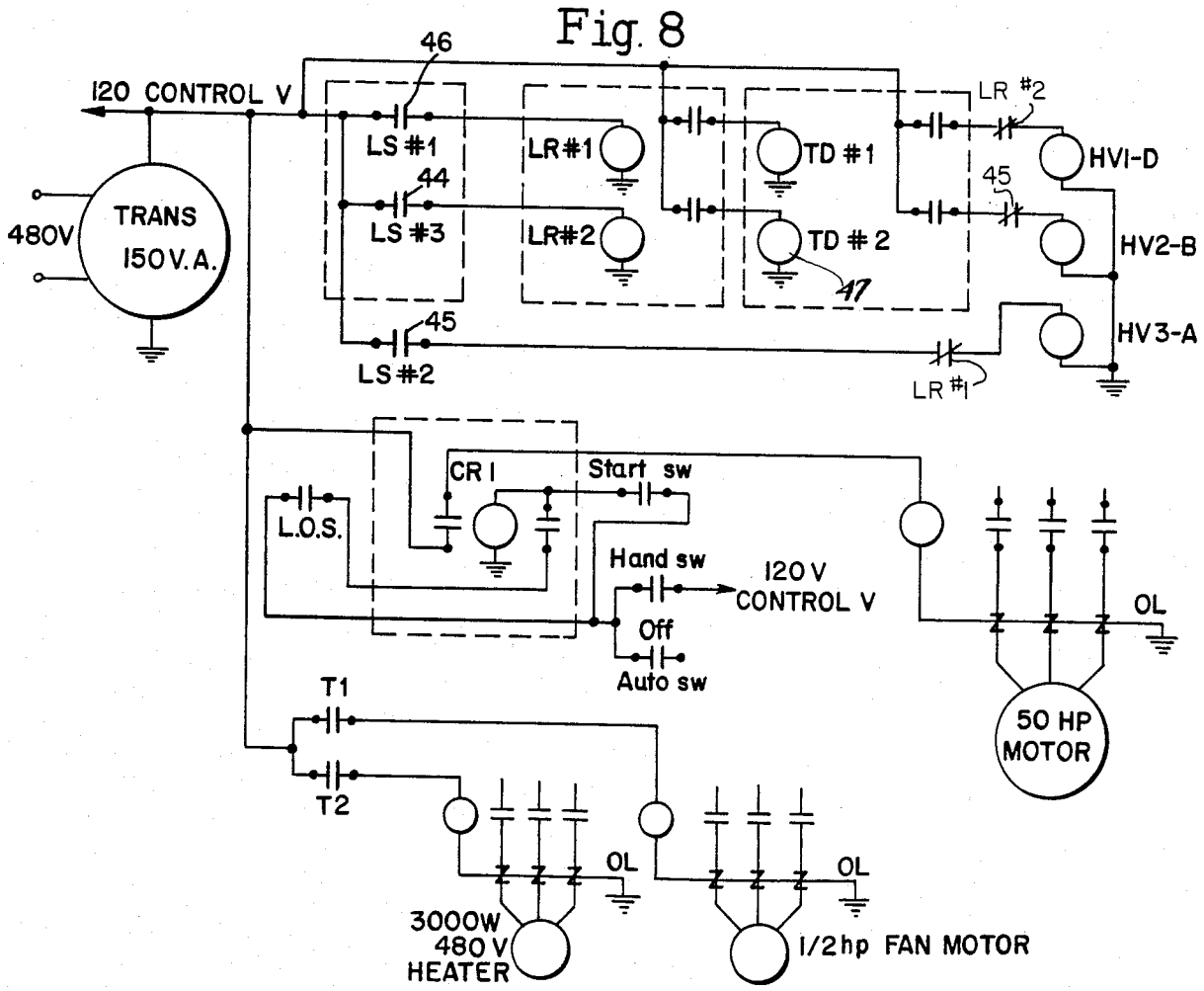

OIL WELL PUMPING APPARATUS

TECHNICAL FIELD

This invention relates to a surface oil well pumping apparatus which brings oil to the surface in a well which has been drilled and is or has been producing but the output of which has been substantially reduced and relates to use with a well which has lost gas pressure to force oil to the surface and which has been force flooded with water and an oil water mixture is pumped to the surface where the oil and water are separated.

BACKGROUND ART

In surface pumping of oil wells where the polish rod raises and lowers a string of sucker rods a mile or longer to pump oil to the surface the stress and stretch of the sucker rod string together with the weight of the oil raised by the strings have caused numerous problems due to the motion up and down of the long string of rods which when subjected to the weight of the oil causes a rubber band effect of stretching the rod string and over travel between both maximum raised and lowered condition. This problem has been appreciated by the prior art at least since 1946 in the two U.S. patents to Paule Noll et. al. Nos. 2,504,218 and 2,572,748 and even more recently by Robert G. James in 1971 as shown in his U.S. Pat. No. 3,782,117.

The fact still remains notwithstanding the presence of these teachings sucker rod strings are still frequently broken, requiring pulling, often fishing for the broken end, of a mile or more of sucker rod string which results in loss of production in the well, cost of pulling the rod string and its replacement which at least in part has been caused by rod stretch, over travel and an inadequate time period in a mechanical system to dampen out the oscillations in too quick a reversal in either up or down stroke.

DISCLOSURE OF THE INVENTION

Accordingly, the present invention to achieve substantial reduction of breaking of sucker rod strings provides for a hydraulic drive for raising and lowering the polish rod and rod string with sensors positioned to be actuated by the ram of the hydraulic drive to decelerate the rod string on lowering as it approaches the bottom of the stroke, a sensor to detect the lower limit of the stroke to stop the ram and keep it stopped for a time period sufficient to permit damping of the sucker rod string stretch and stress before starting the weight mass up hole with the additional weight of oil taken on by the string during its rest at the bottom of its stroke. Both the maximum down and up stroke of the rod string require a pause, at the top to allow oil to enter the well hole and at the bottom to dampen out rod stretch and stress which causes fatigue and break in rod.

The present invention while providing for the above also permits simple quick adjustment of pump stroke length and quick simple adjustment of dwell or pause periods to cope with varying viscous conditions of the oil being pumped by employing structure and hydraulic and electric circuitry not taught nor suggested by the prior art.

The pause at top of stroke is very important to recover hi-viscosity oil not recoverable at present by conventional prior art apparatus.

The present invention to achieve substantial recovery of hi-viscosity oil not recoverable at present by conventional prior art is accomplished with a sensor positioned to be actuated by the ram of the hydraulic drive. When the sensor is actuated, it energizes a time delay relay which holds the sucker rod string in the upper most raised position allowing the suction to be maintained on the bottom hole pump with the standing valve open. This allows the hi-viscus oil to enter the bottom hole pump barrel. When the time delay relay is released, the sucker rod string starts its downward movement closing the bottom hole standing valve. This traps the hi-viscus oil in the pump barrel which is then displaced by the downward movement of the plunger in the bottom hole pump.

BRIEF DESCRIPTION OF DRAWINGS

In the accompanying drawings:

FIG. 8 is an electrical schematic of the electrical system controlling the hydraulic system.

FIG. 9 is a diagrammatic block layout of the electrical control panel.

BEST MODE FOR CARRYING OUT THE INVENTION

Figure 1:
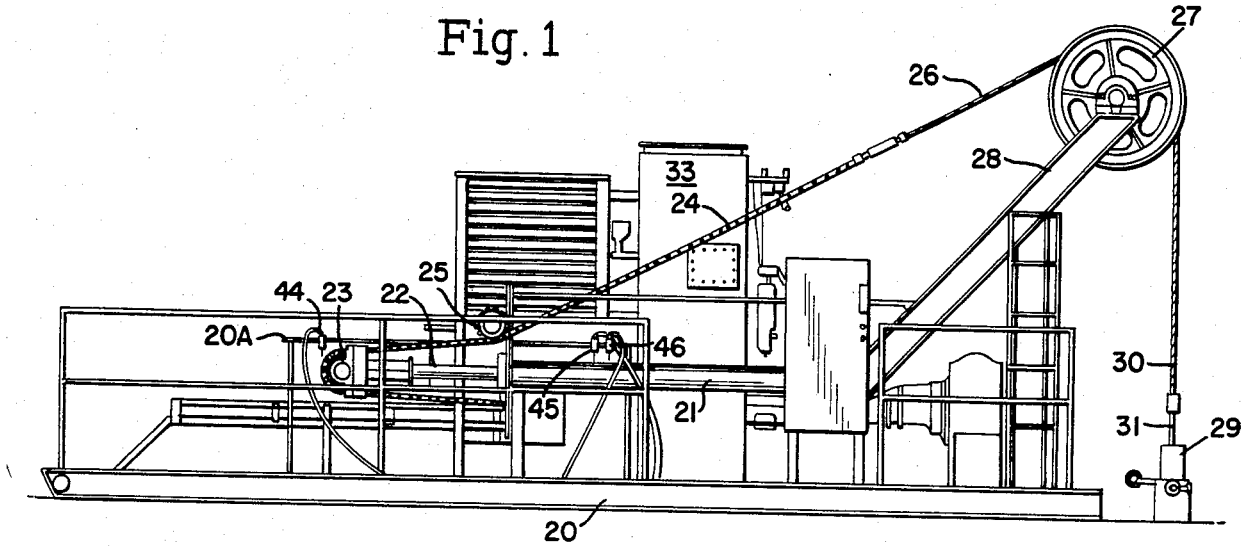
FIG. 1 is a front elevational view of a surface oil well pumping appartus in accordance with the present invention.

Referring to FIGS. 1 through 5, 20 designates a base frame upon which is mounted a hydraulic cylinder 21 and ram 22. A sprocket 23 is mounted for free rotation on the free end of the ram 22 and has a drive chain 24 in engagement therewith, one end of the chain 24 being rigidly secured to the base frame 20 and the other end being passed beneath an idler sprocket 25 giving equal up and down pull on the end of the ram 22 and connected to a cable 26 passed over a sheave or roller 27 rotatably carried in a support 28 located vertically above the well bore 29 and attached to the polish rod 30 and its connected sucker rod string.

Figure 2:
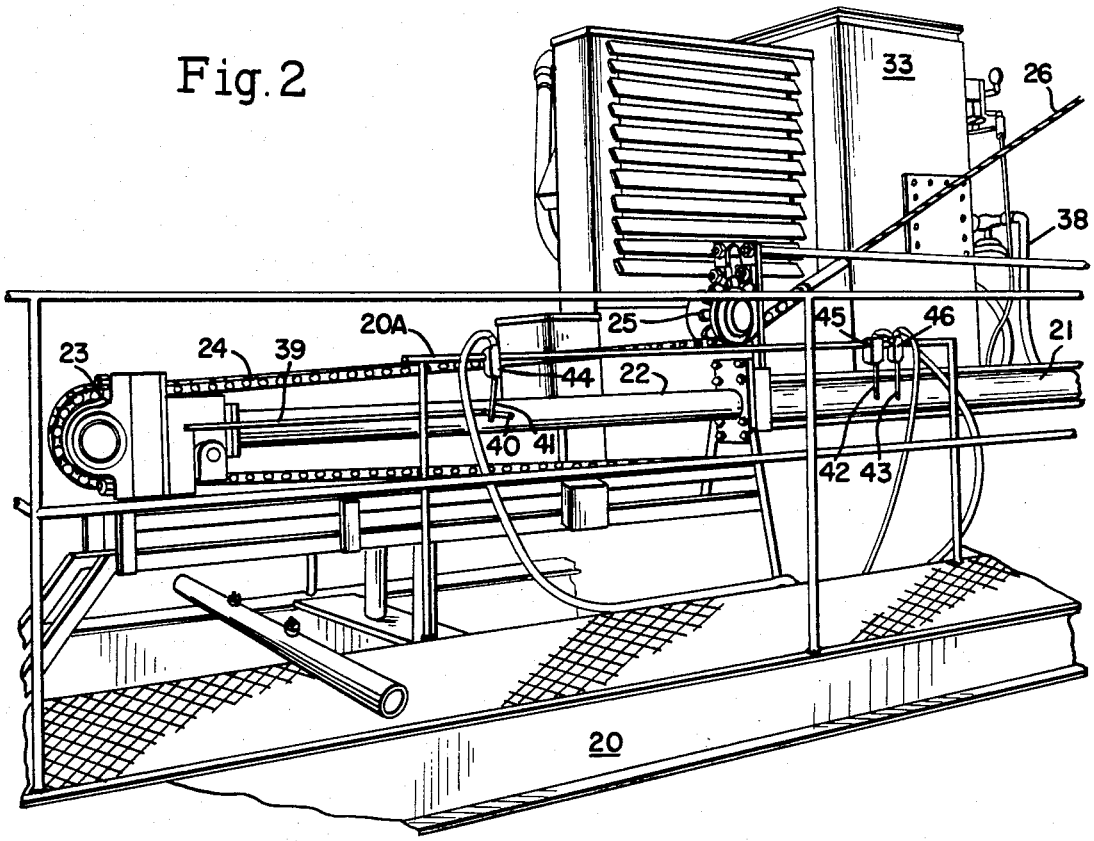
FIG. 2 is a fragmentary rear prespective view of the apparatus of FIG. 1 taken from the left rear.
Figure 3:
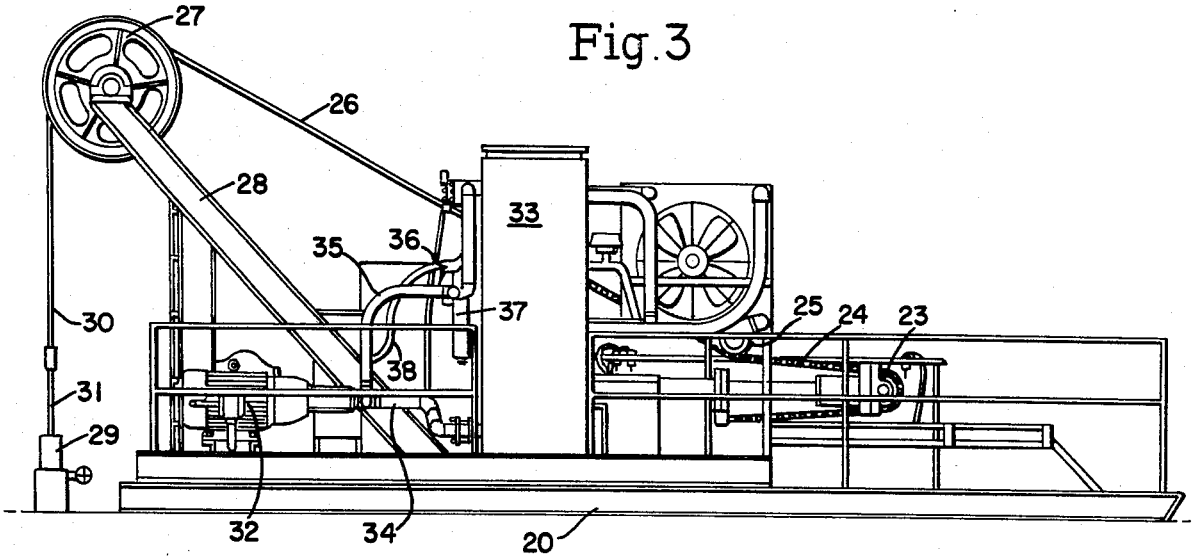
FIG. 3 is a rear elevational view of the apparatus of FIG. 1.
Figure 4:
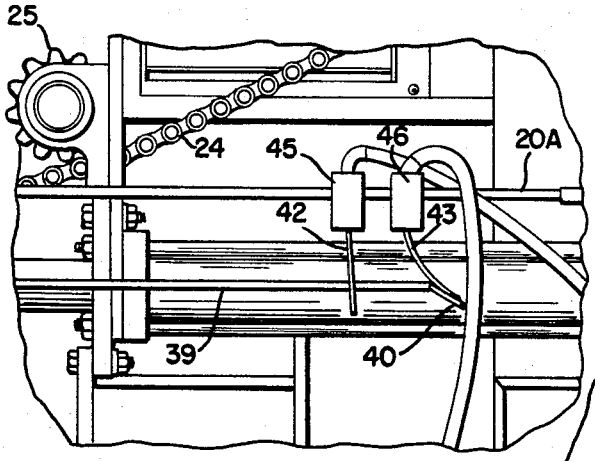
FIG. 4 is a fragmentary side elevational view of the apparatus of FIG. 1 showing the area of the deceleration and lower stop sensor microswitches and operating wands.

The ram actuating system for raising and lowering the sucker rod string comprises a prime mover 21 which may be a diesel, natural gas, gasoline or electric motor driving a hydraulic wobble plate pump 32, as shown in FIG. 3 which receives hydraulic fluid from a reservoir 33 via line 34 and discharge pressurized fluid through line 35 to a oneway valve 36, filter 37, to a ram hose 38 which supplies pressurized fluid to cylinder 21 causing extension of the ram 22 to the position of FIGS. 1 and 2 in which a ram carried striking bar 39 having a projecting rod 40 to engage the wands 41, 42, 43 to limit switches 44, 45, 46 to control extension and retraction of the ram 22 which raises and lowers the polish rod and sucker rod string 31.

The striking bar 39 and rod 40 are shown at their uppermost extension in FIG. 2 with the sucker rod string 31 at the top of its pump stroke, engaging wand 41 of limit switch 44 to energize solenoid SB and de-energizing solenoid SD to permit bleeding off and retraction of ram 22 after a time delay switch 47 which was energized when limit switch 44 was engaged and timed out. After release of time delay switch 47, solenoid SD is de-energized permitting fluid from the pump to pass through system relief valve 48 (RV-1). The weight of the sucker rod string together with the bleeding off of cylinder 21 retracts the ram 22 as shown in FIG. 1 until the striking bar 40 engages wand 42 of limit switch 45 (no time delay) energizing deceleration solenoid valve A and deenergizing down mode solenoid valve B. After deceleration and at bottom of stroke, striking bar 40 engages wand 43 of limit switch 46 deenergizing deceleration solenoid valve A and energizing up mode solenoid valve D and time delay 47. After time delay relay 47 times out the cycle starts over raising the polish rod and connected sucker rod string.

After fluid passes through valve 48 (RV-1) it returns to surge tank which is the uppermost section of the reservoir 33. The fluid from the surge tank is then gravity flowed or pumped into condenser 49 shown in FIG. 7. After cooled fluid is discharged from condenser it is passed to reservoir 33.

The three operating modes of the ram are:

DOWN MODE, RETRACTION OF RAM (LOWERING OF POLISH ROD)

Figure 5:
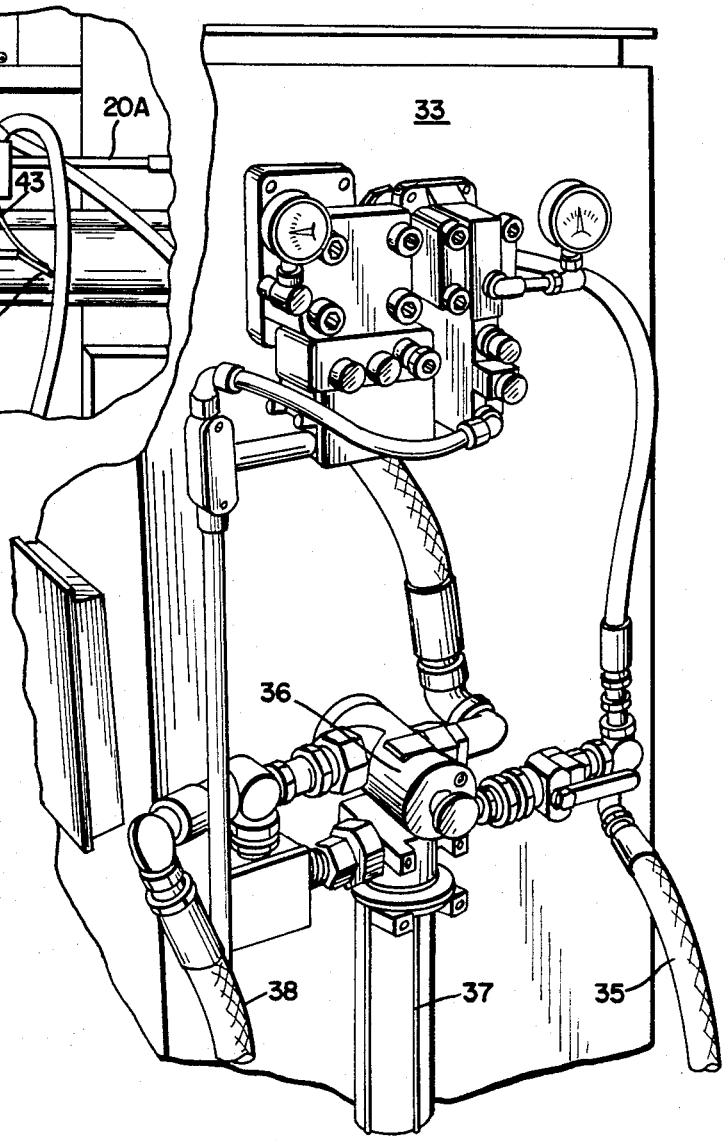
FIG. 5 is a fragmentary perspective view of the side wall of the hydraulic reservoir with metering valves and hydraulic supply to cylinder.

Striking rod 40 engages wand 41 of limit switch 44 activates time delay relay 47 which energizes solenoid B starting retraction of ram only after time delay relay 47 has timed out. Speed of ram retraction is predetermined by manual setting of valve 36 (FIG. 5).

DECELERATION OF DOWN MODE SPEED OF RAM (DECELERATION OF POLISH ROD)

Striking bar 40 energizes the deceleration valve A causing deceleration of the fall of the sucker rod string on the decelerated bottom part of the stroke. Valve D and time delay switch 47 stop the downward travel of the rods. When striking bar 40 energizes solenoid A, fluid is forced through a smaller predetermined setting than that of valve B thereby retarding the speed of the retracting ram which is maintained until the striking bar 40 engages wand 43 of limit switch 46 which deenergizes solenoid A stopping ram travel and actuating time delay relay 47 which energizes solenoid D.

Figure 6:
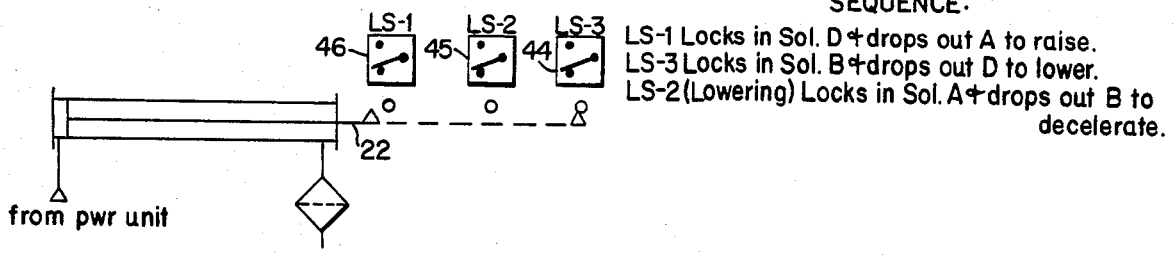
FIG. 6 is an operational sequence schematic of the cylinder and ram together with limit switches operated thereby.
Figure 7:
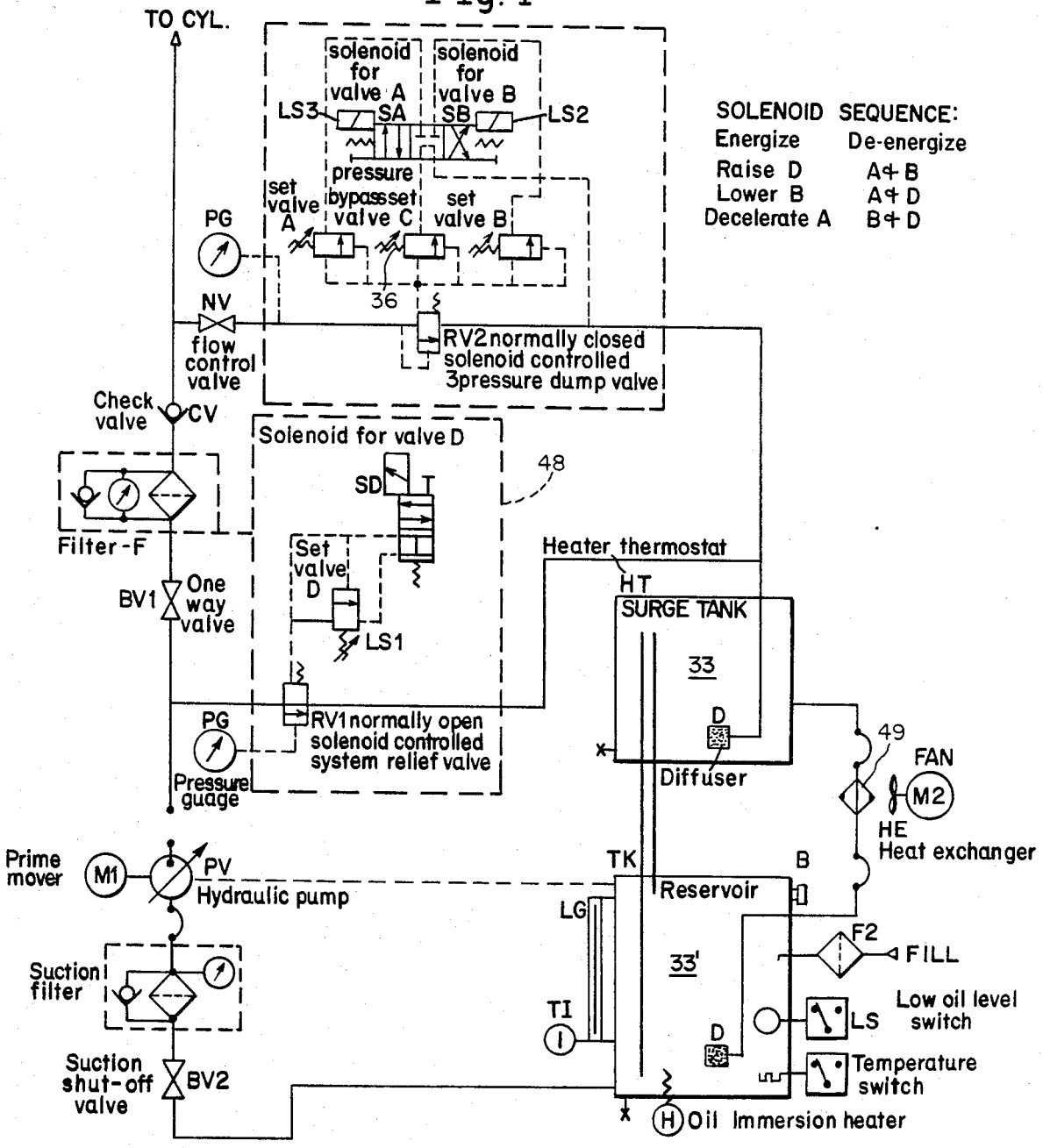
FIG. 7 is a hydraulic schematic of the system of the present invention.
Figure 10:
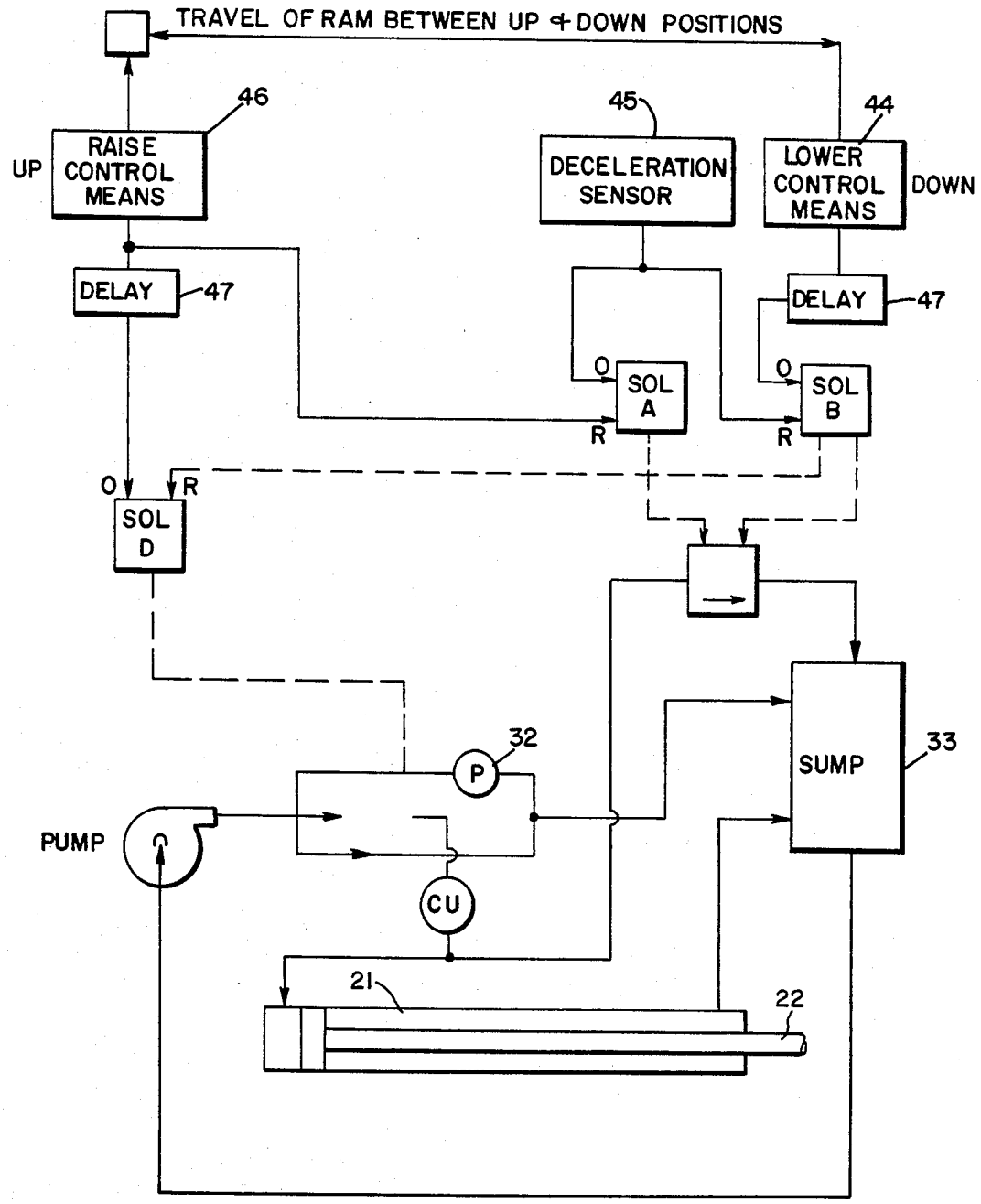
FIG. 10 is a modified form of hydraulic schematic for operating the apparatus of the present invention.

As shown in FIGS. 6 and 7, particularly the limit switch sequence of the solenoid sequence, when LS2 on lowering is actuated this locks in solenoid SA and drops out SB which shifts from set B which is a manual variable valve which is set to bleed off at a predetermined rate to set A which is set to bleed off at a slower rate through RV2 back to the surge tank 33 causing the lowering of the sucker rod string to slow down prior to reversal of the sucker rod string up hole. Valve RV2 is set for a predetermined pressure to permit by pass of fluid to control the speed of down travel. The upstroke flu flow is brought from the reservoir 33 through BV2 into PV, through BV1 through CV to the cylinder 21 providing the upstream Pressure fluid on the upstroke cannot go to the surge tank 3 from PV because RV1 (valve D) is closed on the upstroke.

UP MODE, EXTENSION OR RAM (RAISING OR POLISH ROD)

Striking rod 40 engages wand 43 of limit switch 46 which energizes solenoid D and de-energizes solenoids A and B thereby forcing fluid into cylinder 21 causing ram 22 to raise, only after time delay relay 47 is timed out.

When the striking bar projection rod 40 engages wand 43 of limit switch 46, a latching relay is energized which is in circuit to energize a time delay relay 47 and open the circuit releasing solenoid A. When the relay 47 times out solenoid D is energized for raising.

The above describes one pumping cycle (down-up). The length of stroke can be changed by either increasing or decreasing the distance between microswitches 44 and 46 which are slidably movable along and carried by a bar 20A secured to the base frame 20. The limit switches are positionable along the bar 20A and are secured at a desired position by tightening a bolt which may be readily achieved with a crescent wrench.

The frequency of pumping strokes may be increased or decreased by varying the position of the wobble plate in the hydraulic pump 32 increasing hydraulic fluid flow in gallons per minute to drive ram 22 to raise the polish rod 30.

The time delay switch or relay 47 is a SIEMENS PNEUMATIC TIMING RELAY 7 PQ 80044 and the limit switches 44, 45, 46 are SQUARE D 862 J Class 9007. The time delay relay provides a variable timing range from 0.2 to 60 seconds.

What we claim is:

1. For use with a polish rod and connected string of sucker rods, a surface oil well pumping apparatus with a hydraulic control circuit comprising:

(a) a main hydraulic cylinder and single acting main ram connected to raise and lower the polish rod, limit switch means variably positionable for actuation along the travel stroke of said main ram element having actuating elements positioned to be triggered at predetermined positioning of said main ram element, one of said limit switch means being positioned to be actuated to control stopping the main ram travel in an upward direction of said rod when the polish rod is at its uppermost position, another of said limit switch means being positioned to be actuated along the stroke of said main ram travel for deceleration control of the downward travel of said polish rod as the polish rod approaches the lower limit of its travel and a third limit switch means being positioned to be actuated by said main ram element when the polish rod is at its lowermost position for stopping the polish rod before commencement of an upward pumping stroke of said polish rod, (b) hydraulic means in said control circuit to cause said main ram to raise the polish rod in one direction and to lower the polish rod in the other direction, (c) variable control means for positioning said limit switches at various places along the travel of the main ram to control the hydraulic circuit, (d) hydraulic control means to cause said main ram to gradually retard the lowering rate of the sucker rod string in response to the limit switch means for deceleration control, (e) and pause means responsive to said first and third limit switch means for control of said hydraulic circuit to cause said main ram to maintain the sucker rod string in the maximum raised position for a predetermined time period to permit oil to flow into the sucker rod string to be pumped to the surface.

2. A surface oil well pumping apparatus as claimed in claim 1 wherein the three limit switch means are adjustably carried on a bar positioned adjacent one another along said bar to vary the pumping stroke of the polish rod and its connected sucker rod string to selectively increase or decrease the stroke of said polish rod.

3. For use with a polish rod and connected string of sucker rods having a bottom hole sub-surface pump; a surface oil well pumping apparatus comprising:

(a) a main hydraulic cylinder and single acting ram connected with hydraulic circuits to raise and lower the polish rod, (b) lower and upper limit electrical switch control means variably positionable to be actuated by the position of said main ram for control of said main ram to raise the polish rod in one direction and to lower the polish rod to the other direction;

(c) electrical decelerating switch sensor means responsive to variable predetermined downward travel positions of said polish rod, (d) electric solenoid controlled hydraulic valve means responsive to said electrical decelerating sensor means operating said main ram to gradually retard lowering said sucker rod string for control of the speed during the down stroke causing the main ram to gradually retard the lowering rate of the sucker rod string, (e) electrical solenoid controlled valve operating means responsive to the limit switch means for controlling the hydraulic circuit with said main ram said valve operating means including delay means to maintain the sucker rod string in the lower position for that time period necessary to dampen the stretch stress of said sucker rod string as a result of the deceleration of the string in response to the gravitational fall of the rods, (f) a solenoid controlled valve responsive to said electrical limit control switch means to apply hydraulic lifting power from said main ram to the string after said time period thereby without danger of breaking the string as a result of upstroke power combined with said stretch stress, (g) and means stopping the main ram in the maximum raised position for a predetermined time period to permit oil to flow into the sucker rod string to be pumped to the surface.

4. A surface oil well pumping apparatus as claimed in claim 3 wherein said upper and lower control means are two limit switch means adjustably mounted on a rod with their actuating elements positioned to be actuated by the position of said main ram.

5. A surface oil well pumping apparatus as claimed in claim 4 wherein said hydraulic decelerating sensor means is a third limit switch means adjustably mounted on said rod between said two limit switches with an actuating element positioned to be actuated by the position of said main ram.

6. A surface of oil well pumping apparatus as claimed in claim 5 wherein said hydraulic means responsive to said electric sensor means comprises flow means to restrict the flow of oil from said main ram to slow travel thereof and control the rate of travel of said polish rod.

7. A surface oil well pumping apparatus as claimed in claim 6 wherein said timing means for controlling hydraulic circuit including said solenoid controlled valve is controlled by a time delay relay operable to shut off hydraulic fluid from said main cylinder of the relay delay period to prevent upward travel of the polish rod.

* * * * *